US006502408B1

(12) United States Patent
Corcoran

(10) Patent No.: US 6,502,408 B1
(45) Date of Patent: Jan. 7, 2003

(54) COOLING CABINET

(75) Inventor: Terence Corcoran, Merseyside (GB)

(73) Assignee: Gt. B Components Limited, Merseyside (GB)

( * ) Notice: Subject to any disclaimer, the term of this patent is extended or adjusted under 35 U.S.C. 154(b) by 0 days.

(21) Appl. No.: 10/030,892

(22) PCT Filed: May 12, 1999

(86) PCT No.: PCT/GB99/01502

§ 371 (c)(1),
(2), (4) Date: Nov. 9, 2001

(87) PCT Pub. No.: WO99/58915

PCT Pub. Date: Nov. 18, 1999

(30) Foreign Application Priority Data

| | | |
|---|---|---|
| Feb. 19, 1998 | (GB) | 9903917 |
| May 13, 1998 | (GB) | 9810293 |
| Sep. 29, 1998 | (GB) | 9821073 |

(51) Int. Cl.[7] ..... F25D 13/06

(52) U.S. Cl. ..... 62/63; 62/250; 62/382; 62/457.3; 193/35 R; 211/59.2; 312/72

(58) Field of Search ..... 62/63, 250, 382, 62/3.64, 457.3; 193/35 S, 35 R; 211/59.2, 74; 221/312 R; 312/36, 45, 60, 72

(56) References Cited

U.S. PATENT DOCUMENTS

| | | | | |
|---|---|---|---|---|
| 3,314,250 A | * | 4/1967 | Weber | 62/256 |
| 4,164,992 A | | 8/1979 | Luber | |
| 4,194,647 A | | 3/1980 | Spurrier | |
| 4,368,625 A | | 1/1983 | Platt | |
| 4,510,770 A | | 4/1985 | Ziegler et al. | |
| 4,823,983 A | | 4/1989 | Groover et al. | |
| 4,899,904 A | * | 2/1990 | Dooley et al. | 220/592.16 |
| 5,247,798 A | | 9/1993 | Carpenter | |
| 5,505,054 A | * | 4/1996 | Loibl et al. | 62/63 |
| 5,806,712 A | * | 9/1998 | Siemsen et al. | 221/67 |
| 5,819,937 A | * | 10/1998 | Walker | 206/429 |
| 6,109,059 A | * | 8/2000 | Lebrun | 62/457.5 |
| 6,173,582 B1 | * | 1/2001 | Hixson | 62/457.4 |
| 6,381,966 B1 | * | 5/2002 | Barrow | 62/3.61 |

FOREIGN PATENT DOCUMENTS

| | | |
|---|---|---|
| EP | 004921 | 10/1979 |
| EP | 314323 | 5/1989 |
| EP | 499013 | 8/1992 |
| GB | 2028480 | 3/1980 |
| GB | 2225098 | 5/1990 |
| GB | 2247068 | 2/1992 |
| GB | 1291141 | 9/1992 |
| GB | 2324597 | 10/1998 |

* cited by examiner

*Primary Examiner*—William E. Tapolcai
(74) *Attorney, Agent, or Firm*—Caesar, Rivise, Bernstein, Cohen & Pokotilow, Ltd.

(57) ABSTRACT

A cooler cabinet having an opening defining an access to the interior of the cabinet, the rear of the cabinet being the coldest part of the cabinet, the cabinet comprising at least one shelf with spaced apart vertical walls which together define a flow path having an inlet and an outlet, the outlet being at the front of the cabinet so that food containers to be cooled can be retrieved in succession, the flow path being arranged so that containers pass through the rear of the cabinet before they reach the outlet.

18 Claims, 5 Drawing Sheets

COOLING CABINET

The invention relates to apparatus for cooling or chilling foodstuffs, particularly drinks in containers; examples being beers, soft drinks, cordials in cans or bottles; and the like.

It is one object of the invention to provide a chiller cabinet either as original equipment or as a retrofit in which the food containers spend a prolonged time in the coldest region of the cabinet and are retrieved in succession and also that provides simple means for moving containers along a flow path to be presented to the user.

In one aspect the invention provides a cooler cabinet having an opening at the front to provide access to the interior of the cabinet, cooling means arranged so that the coldest part of the cabinet is towards the rear, the cabinet comprising at least one shelf having spaced apart vertical walls which together define a flow path having an inlet and an outlet, the outlet being at the front of the cabinet so that food containers to be cooled can be retrieved in succession, the flow path being arranged such that containers pass through the rear of the cabinet before they reach the outlet. It will be noted that the containers are disposed vertically, i.e. upright.

In another aspect the invention provides a cooler cabinet having an opening at the front to provide access to the interior of the cabinet, vertically spaced walls being present within the cabinet to define at least one flow path for containers to be cooled; the flow path having an inlet and an outlet, which is at the front of the cabinet; the flow path being shaped to prolong the period for which the containers are in the cabinet and to cause them to reach the outlet in succession; the floor of the flow path having at least one downwardly inclined portion and friction reducing means along at least part of its floor.

The flow path is preferably arranged so that the containers are taken in succession to the colder regions of the cabinet which typically will be at the rear.

Preferably individual flow channels are arranged in stacks side by side to form an array.

In one preferred aspect, the invention provides a cooler cabinet as defined wherein the floor of the shelf is shaped to encourage movement of the containers towards the outlet. While the floor may be shaped in different ways to encourage forward movement, it is preferred to incline a length portion of the floor, downwardly forward. The floor may have a uniform inclination or it may be made up of one or more length portions each inclined at a different angle.

In another preferred feature means are present to prevent removal of the last loaded container from the inlet of the flow path. While the means may take a variety of forms, e.g. a piston, pressurised air flow or the like, it is preferred to provide a one way gate. The gate may be spring biased and may have one or a pair of doors hinged at the side or from above or from below.

In another preferred feature means are present to direct containers around a curvature in the flow path. The means for moving the containers in the defined way may take a variety of forms. In one preferred embodiment the means is a turntable. This may be passive or powered; means may be present to hold each container, and to cause it to emerge on its travel towards the outlet with a predetermined face of the container facing forward.

In preferred embodiments the friction reducing means (where present) are rollers or raised sections of the walls and/or floor to reduce contact area and therefore frictional resistance to sliding.

In a preferred feature the vertically spaced apart walls have at least one rail arranged to reduce friction between the side of the containers and the rail as the containers move along the flow path. Rollers may be arranged to rotate about a vertical axis along a portion of the wall defining the guide path.

The outlet portion of the flow path may have at least one cross strap positioned at the outlet.

The invention includes the method of cooling and dispensing the cooled containers.

In order that the invention may be well understood it will now be described by way of example only with reference to the accompanying diagrammatic drawings, in which.

The same reference numerals are used where possible in describing the different embodiments.

Figure 1:
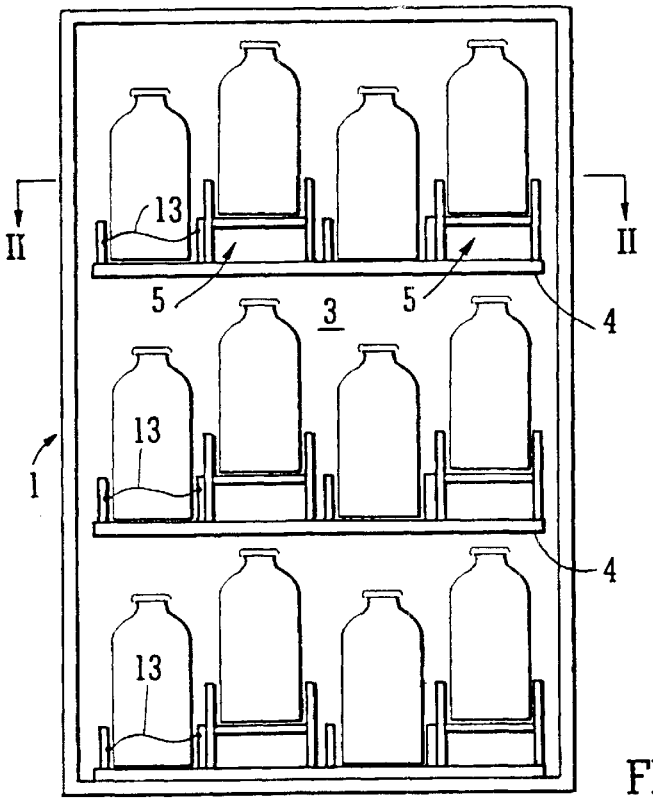
FIG. 1 is a front elevation of one cabinet of the invention.
Figure 2:
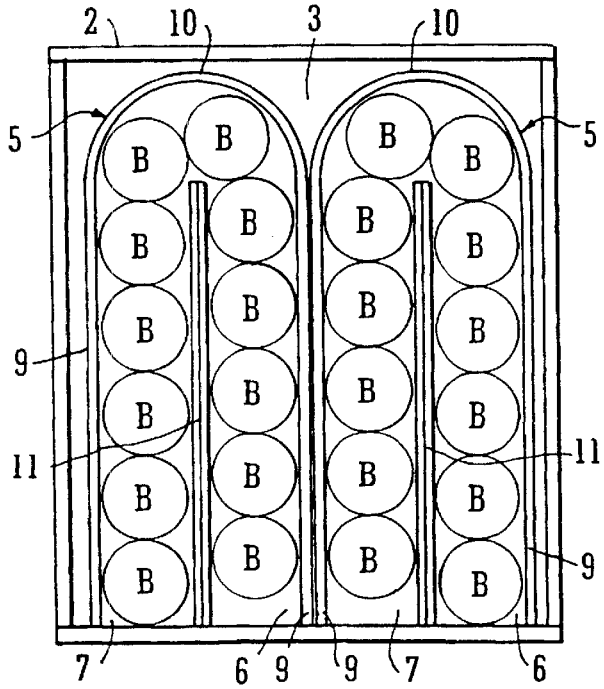
FIG. 2 is a transverse sectional view taken along line II—II on FIG. 1.
Figure 3:
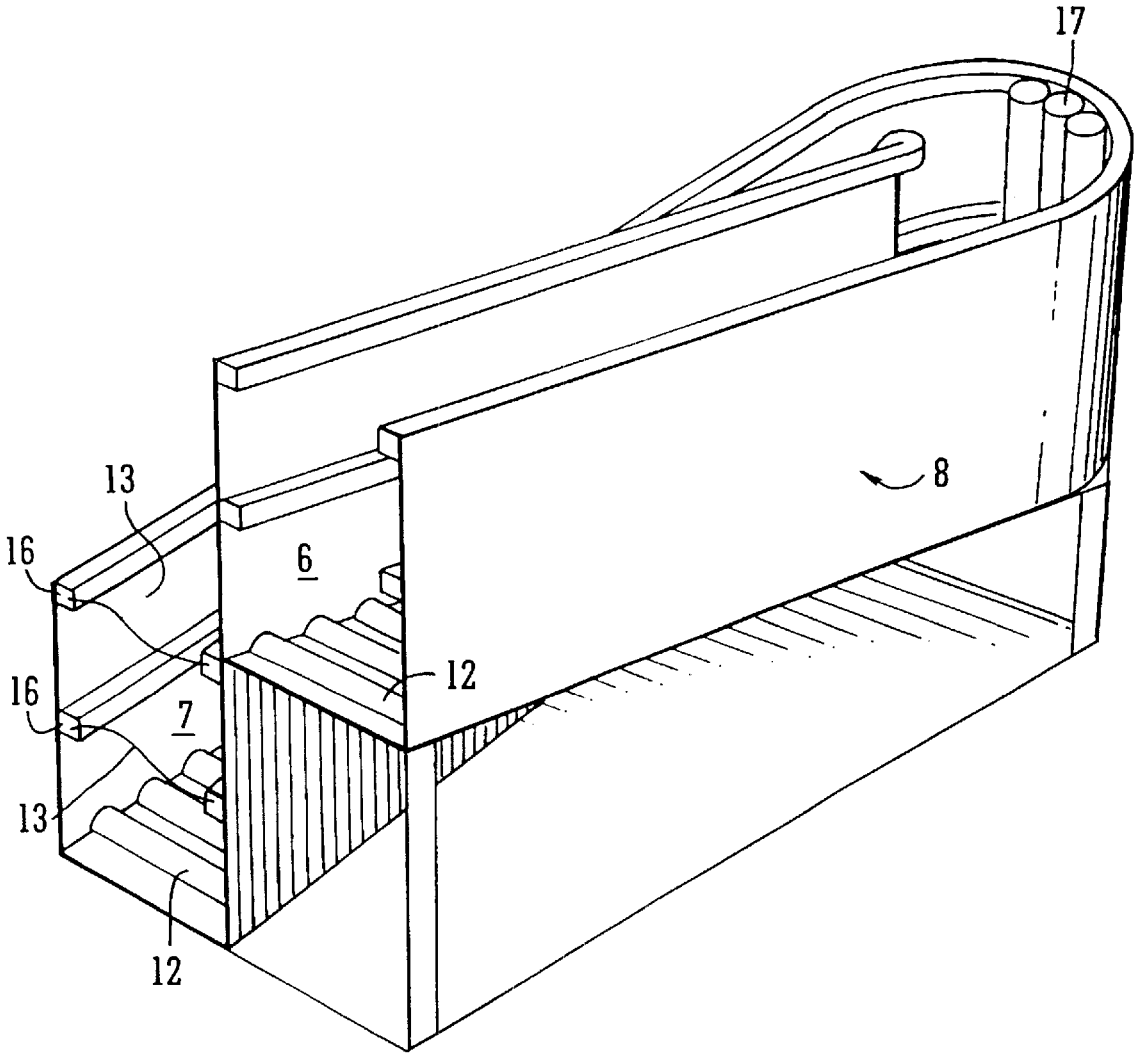
FIG. 3 is a perspective view of an individual flow path of a container.
Figure 4:
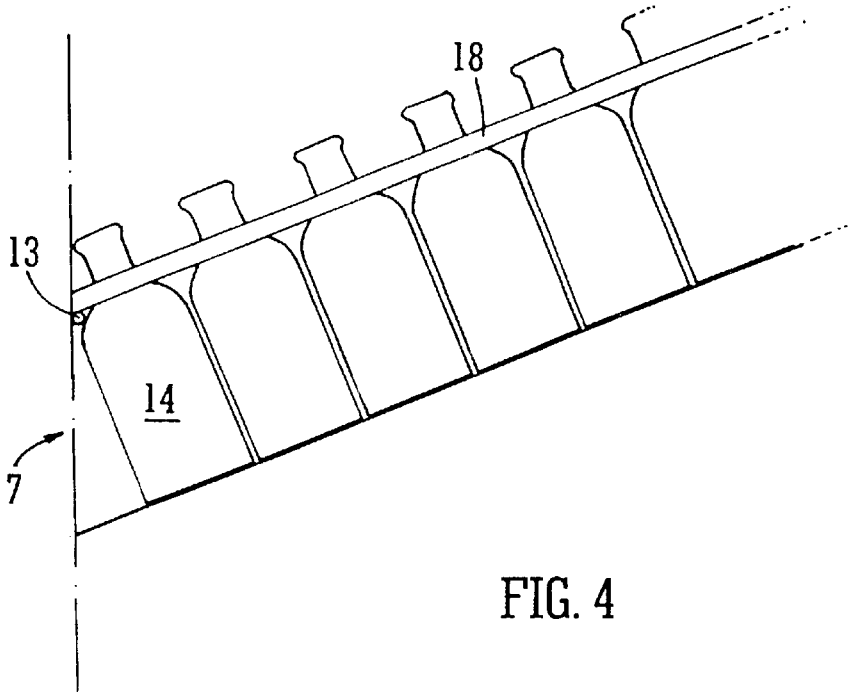
FIG. 4 is a side view of part of a flow path showing a exit section with restraining strap.

The cabinet 1 has a front opening door or curtain (not shown) and towards its rear wall 2 apparatus (not shown) for cooling or chilling the cabinet chamber 3. Within the cabinet chamber are a number of flow paths 5 arranged side by side and one above another. Chutes may be placed side by side on each shelf 4 or walls may be designed to provide supports to eliminate the need for shelves. Each chute 5 is generally 'U' shaped in plan, as shown in FIG. 2, and has an inlet portion 6 and outlet portion 7. Each chute 5 has an outer wall 8 having two straight sections 9 and a semi-circular section 10. A separate straight portion 11 acts as a divider to define two elongate channel portions. As shown in FIG. 3 the walls 9, 10 and 11 may have one or more longitudinal rails 16. Optionally, the rails may be supported by posts (not shown) in which case walls may be omitted. The floor of the chute is inclined downwardly from the inlet portion 6 to the exit portion 7 (see FIG. 3). The floor may have rails (not shown) so as to reduce friction between the containers 14 and the floor so aiding them to slide down the chute without any external force being applied. Optionally, the floor may have rollers 12 for the same purpose. The inside of the semi-circular wall 10 may have along at least part of its length a series of rollers 17 arranged to rotate about a vertical axis to assist the containers in turning through 180° by reducing friction between the walls of the containers and the inner surface of wall 10.

Figure 5:
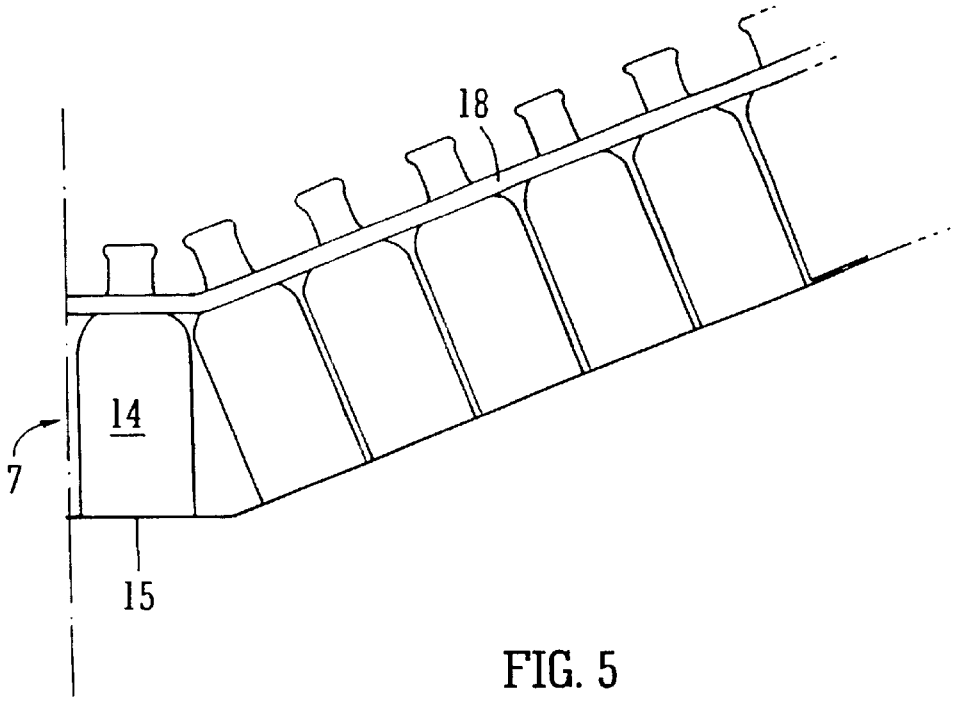
FIG. 5 is a side view of part of a flow path showing an exit section with a horizontal portion at the end of the floor.

At the exit portion 7 there may be one or more straps 13 held at each end to the walls. Such straps help orient the leading container to be dispensed 14 in a generally vertical position. This offers the significant advantage of positioning any label etc on the container so that it can be readily viewed by the user. The same effect may be achieved by including a short horizontal section of floor 15 near the exit 7 of the chute (FIG. 5).

Figure 6:
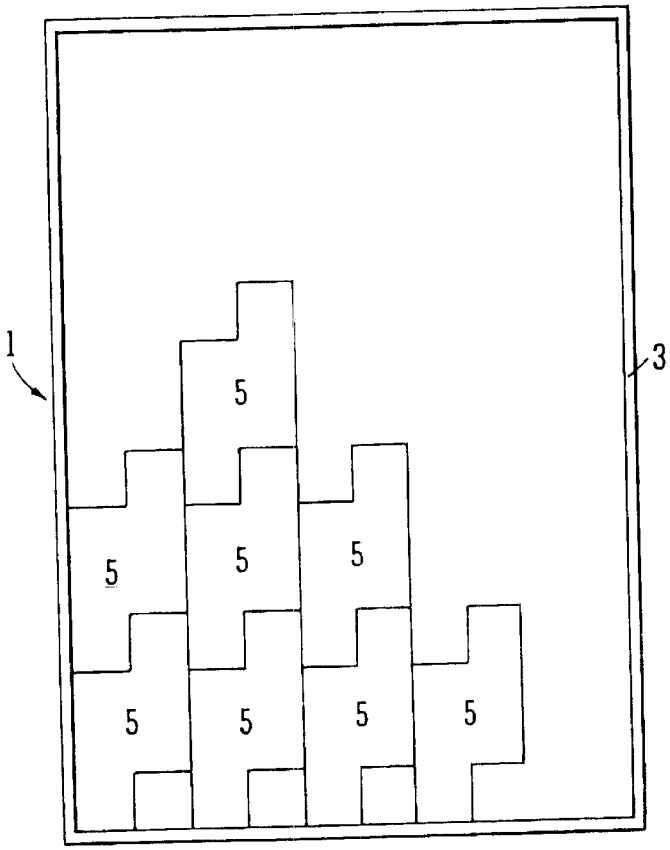
FIG. 6 is a front view of a cabinet with individual flow paths stacked one on top of another.
Figure 7:
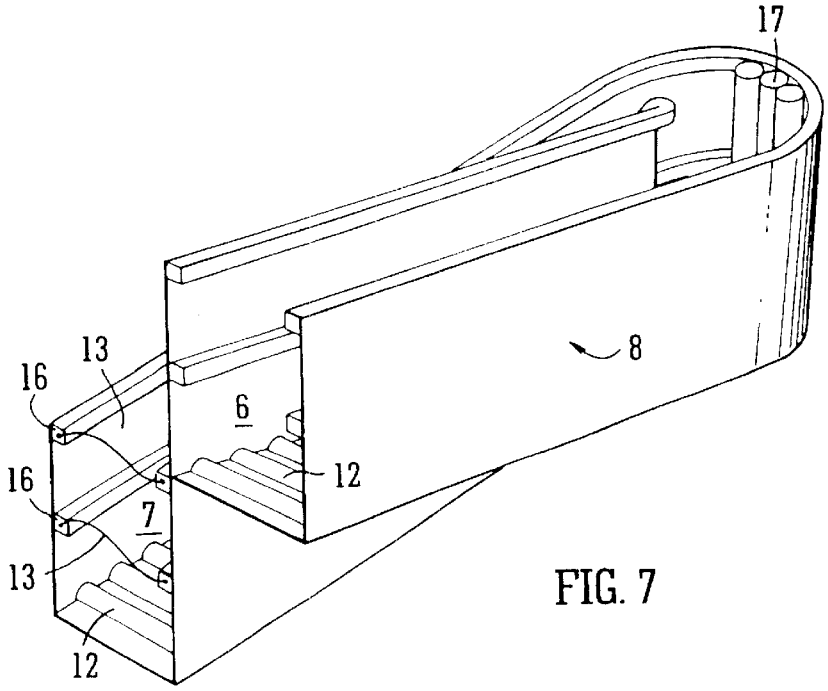
FIG. 7 is a perspective view of an individual flow path arranged to facilitate vertical stacking shown in FIG. 6.

Individual flow paths 5 may be arranged to facilitate stacking one on top of another in columns within the cooler cabinet (FIG. 6). This may be achieved for example by modifying the base portion of a flow path (FIG. 7) to remove the horizontal floor. There are, of course, many other ways in which such flow paths can be configured to allow vertical stacking.

Figure 8:
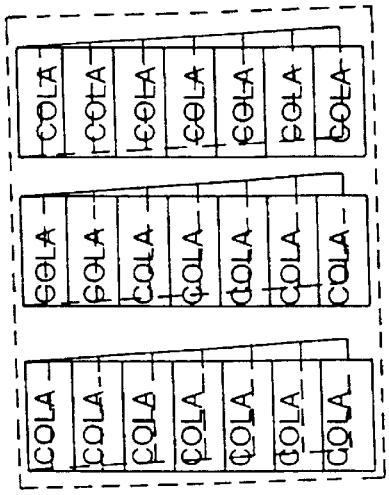
FIG. 8 is a side elevation of another embodiment of this invention.
Figure 9:
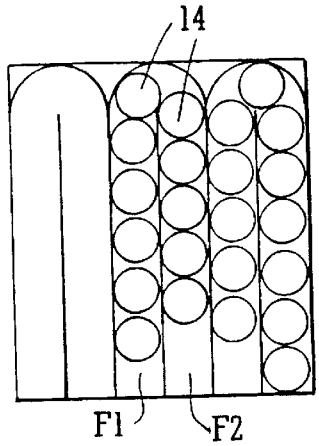
FIG. 9 is a plan of the embodiment of FIG. 8.

In the embodiment shown in FIGS. 8 and 9, the floor is U-shaped, as seen in plan, but the inlet side F1 slopes downwardly to the rear and the outlet side F2 also slopes downwardly. The inclination will be selected according to the dimensions of the parts. In an evaluation a slope of about 1 in 6 proved useful but this value is not critical. As a result, the cans or bottles 14 slide around at the rear of the track and to the front of the cabinet. This helps ensure that the cans dwell in the cabinet for the maximum time, as well as the stock being used on a first in-first out basis.

The surface of the partitions and/or the floor may be formed of a low friction material such as a plastic.

Figure 10:
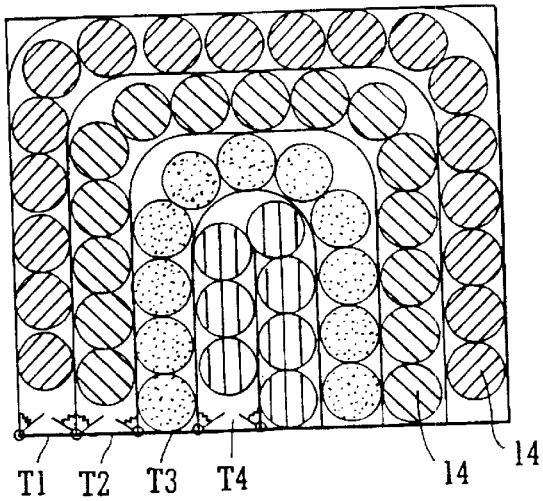
FIG. 10 is a plan of another embodiment of the invention.

As shown in FIG. 10, different partitions may be present to define different flow paths for different product lines. FIG. 10 also shows that a gate T1,T2,T2,T4 is present at the inlet of each flow path. As shown each gate comprises two hinged doors spring biased towards the closed condition so that when a can 14 is to be inserted into the flow path the doors must be forced apart. This will prevent people taking the cans from the inlet side of each flow path.

Figure 11:
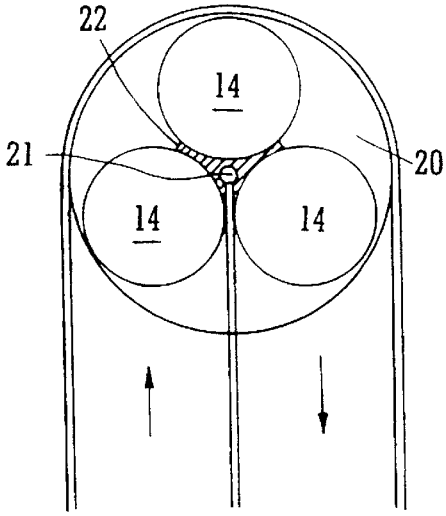
FIG. 11 is a plan of part of another embodiment of the invention.

In the embodiment of FIG. 11 a turntable 20 is present in the floor at the bight of the flow path, arranged to accept three cans 14. A spindle 21 extends from above and ends in arcuate arms 22 arranged to engage successive cans 14 and transfer them to the outlet. The rate of rotation (which may be from a power source or just from the urging forward of incoming cans) can be controlled to ensure that a predetermined face of the can faces forward.

What is claimed is:

1. A cooler cabinet for cooling foodstuffs, the cabinet comprising a chamber having a front and a rear, cooling means arranged so that the rear of said chamber is the coldest part thereof, a shelf being present in said chamber, said shelf having opposite walls which define a flow path for said foodstuffs, said flow path extending from a flow path inlet at the front of said chamber to a flow path outlet also at the front end of said chamber, an intermediate portion of said flow path passing through the rear of said cabinet, whereby foodstuffs loaded into the cabinet through said flow path inlet are passed along the flow path to the flow path outlet and on route are cooled by passage through the coldest part of said chamber, they are retrieved from the flow path outlet in the order in which they were loaded into the flow path inlet, and each foodstuff loaded into said flow path inlet urges a previously loaded foodstuff towards said flow path outlet.

2. A cooler cabinet according to claim 1, wherein a plurality of said shelves is present in said chamber to define a plurality of respective flow paths, the shelves being arranged vertically.

3. A cooler cabinet according to claim 1, wherein means are present in said flow path inlet to prevent the removal of the foodstuff last loaded into said flow path inlet whereby the foodstuff can only exit via said flow path outlet.

4. A cooler cabinet according to claim 3, wherein said removal preventing means is selected from the group consisting of spring biased gates, pistons, pressurized air, and straps.

5. A cooler cabinet according to claim 1 wherein means are present in said flow path between said flow path inlet and said flow path outlet to direct said foodstuff around a curvature in said flow path.

6. A cooler cabinet according to claim 5, wherein said directional means comprises a turntable.

7. A cabinet according to claim 6 wherein said turntable includes a plurality of arms, each shaped to hold a foodstuff as it passes through the curvature in said flow path, to direct that a selected face of said foodstuff towards said flow path outlet.

8. A cooler cabinet according to claim 1 wherein the inner surface of said opposite vertical walls of said flow path has a low friction surface.

9. A cooler cabinet according to claim 8 wherein a rail extends horizontally along the inner surface of said opposite vertical side walls of said flow path to reduce friction between the side of said foodstuff in said flow path and said vertical walls of the flow path.

10. A cooler cabinet according to claim 9 wherein vertically aligned friction reducing rollers are present on the inner surface of the opposite vertical side walls of said flow path.

11. A method of cooling foodstuffs, said method comprising the steps of:

a) loading the foodstuff to be cooled into a cooler cabinet, said cooler cabinet comprising a chamber having a front a front and rear, cooling means arranged so that the rear of said chamber is the coldest part thereof, a shelf being present in said chamber, said shelf having opposite vertical side walls which define a flow path for said foodstuffs, said flow path extending from a flow path inlet at the front of said chamber to a flow path outlet also at the front of said chamber, an intermediate portion of said flow path passing through the rear of said cabinet, said loading comprising urging the foodstuffs on to the flow path via the flow path inlet;

b) passing said foodstuff to be cooled along the flow path to the intermediate portion of said flow path at the rear of said chamber, whereby said foodstuff is cooled; and c) passing the cooled foodstuff along said flow path to the flow path outlet at the front of said chamber; whereby the cooled foodstuffs are available for removal from the cooler cabinet in succession in the order in which they were loaded therein.

12. A method according to claim 11, wherein each foodstuff loaded into said flow path inlet urges a previously loaded foodstuff towards said flow path outlet.

13. A method according to claim 11, including the step of preventing the removal of the foodstuff last loaded into said flow path inlet by means of a spring biased gate, pistons pressurized air or straps.

14. A method according to claim 11, including the step of directing said foodstuff around a curvature in said flow by means of a turntable.

15. A method according to claim 14, including the step of holding said foodstuff in a position during said directing step so that a selected face of said foodstuff is facing towards said flow path outlet.

16. A method according to claim 15, wherein said foodstuff is held by a plurality of arms.

17. A method according to claim 11, including the step of reducing the friction between the side of said foodstuff in said flow path and said opposite vertical side walls of said flow path by means of a rail extending horizontally along the inner surface of said vertical side walls of said flow path by means of a rail extending horizontally along the inner surface of said vertical side walls.

18. A method according to claim 11, wherein the friction is reduced between the side of said foodstuff in said flow path and said opposite vertical side walls of said flow path by means of vertically aligned rollers present on the inner surface of said opposite vertical side walls of said flow path.

* * * * *